US010273681B2

(12) United States Patent
Lammer-Klupazek et al.

(10) Patent No.: US 10,273,681 B2
(45) Date of Patent: Apr. 30, 2019

(54) SUPPORT FOR FASTENING FACADE ELEMENTS

(71) Applicant: EJOT Baubefestigungen GmbH, Bad Laasphe (DE)

(72) Inventors: Ewald Lammer-Klupazek, Baierdorf bei Anger (AT); Klaus Holesinsky, Krottendorf (AT); Juergen Hauer, Voitsberg (AT); Martin Leger, Feistritz (AT)

(73) Assignee: EJOT Baubefestigungen GmbH, Bad Laasphe (DE)

( * ) Notice: Subject to any disclaimer, the term of this patent is extended or adjusted under 35 U.S.C. 154(b) by 0 days.

(21) Appl. No.: 15/566,271

(22) PCT Filed: Apr. 14, 2015

(86) PCT No.: PCT/EP2015/058026
§ 371 (c)(1),
(2) Date: Oct. 13, 2017

(87) PCT Pub. No.: WO2016/165741
PCT Pub. Date: Oct. 20, 2016

(65) Prior Publication Data

US 2018/0119412 A1 May 3, 2018

(51) Int. Cl.
*E04B 1/38* (2006.01)
*E04B 1/41* (2006.01)
*E04F 13/08* (2006.01)

(52) U.S. Cl.
CPC ..... *E04B 1/40* (2013.01); *E04F 13/0805* (2013.01); *E04F 13/0839* (2013.01);
(Continued)

(58) Field of Classification Search
CPC .. E04B 1/40; E04B 2103/06; E04B 2001/405; E04F 13/0839; E04F 13/0805; E04F 13/0857
See application file for complete search history.

(56) References Cited

U.S. PATENT DOCUMENTS 4,011,700 A * 3/1977 Sado ..... E06B 9/04 403/104
8,297,019 B2 * 10/2012 Lorenz ..... E04F 13/0805 52/407.4

(Continued)

FOREIGN PATENT DOCUMENTS

DE 3005315 A1 8/1981
DE 102009030635 A1 1/2011

(Continued)

OTHER PUBLICATIONS

International Search Report and Written Opinion Form PCT/ISA/210 and PCT/ISA237, International Application No. PCT/EP/2015/058026, p. 1-11, International Filing Date Dec. 10, 2015 dated search report Aug. 7, 2016.

(Continued)

*Primary Examiner* — Rodney Mintz
(74) *Attorney, Agent, or Firm* — Bond Schoeneck & King, PLLC; George McGuire

(57) ABSTRACT

The invention relates to a support for fastening façade elements of façades, in particular curtain-type, rear-ventilated façades, comprising a wall fastening segment, which is designed for mounting the support to a building wall, and a façade fastening segment, which is designed for the mounting of supporting profiled elements or mounting profiled elements, wherein the façade fastening segment has a first connection segment for the horizontal mounting of supporting profiled elements or mounting profiled elements and a second connection segment for the vertical mounting of (Continued)

supporting profiled elements or mounting profiled elements, which is arranged perpendicularly to the first connection segment.

14 Claims, 10 Drawing Sheets

(52) U.S. Cl.
CPC .... *E04F 13/0857* (2013.01); *E04B 2001/405* (2013.01); *E04B 2103/06* (2013.01)

(56) References Cited

U.S. PATENT DOCUMENTS

| | | | | |
|---|---|---|---|---|
| 9,206,609 | B2 * | 12/2015 | White | F25D 23/085 |
| 2011/0185659 | A1 * | 8/2011 | Lorenz | E04F 13/0805 52/302.1 |
| 2014/0325928 | A1 * | 11/2014 | White | F25D 23/085 52/506.05 |
| 2016/0053494 | A1 * | 2/2016 | White | E04F 13/0805 52/698 |
| 2016/0289977 | A1 * | 10/2016 | Lucchese | E04F 13/0816 |
| 2017/0204600 | A1 * | 7/2017 | Daudet | E04B 1/2403 |

FOREIGN PATENT DOCUMENTS

| | | | | |
|---|---|---|---|---|
| DE | 102011102510 | A1 | 11/2012 | |
| DE | 102012016025 | A1 * | 5/2014 | E04F 13/0807 |
| EP | 1072733 | A2 * | 1/2001 | E04F 13/0808 |
| EP | 2354368 | A2 | 8/2011 | |
| FR | 2924138 | A1 | 5/2009 | |
| GB | 2543944 | A * | 5/2017 | |
| PL | 120099 | U1 * | 12/2012 | |
| RU | 2423588 | C1 | 7/2011 | |
| RU | 126734 | U1 | 4/2013 | |

OTHER PUBLICATIONS

Russian Office action—Federal Service for Intellectual Property, The Federal Public Office "The Federal Institute of Industrial Property" (FIIP), Berezhkovskaya nab., 30, korp.1, Moscow, G-59, GSP-3, 125993, dated Nov. 1, 2018. pp. 1-4.

English translation of Russian Office Action—Federal Service for Intellectual Property (FIIP), dated Nov. 1, 2018. Berezhkovskaya nab., 30, korp.1, Moscow, G-59, GSP-3, 125993, Our ref.: 2017134885/03(061154), Filing date of Apr. 14, 2015, Applicant—EJOT Baubefestigungen GMBH, DE, pp. 1-4.

* cited by examiner

SUPPORT FOR FASTENING FACADE ELEMENTS

This application is the United States National Stage entry under 35 U.S.C. 371 of PCT/EP2015/058026, filed Apr. 14, 2015, the entire disclosure of which is incorporated herein by reference.

BACKGROUND OF THE INVENTION

The invention relates to a wall support for fastening façade elements, in particular for fastening wall or ceiling paneling of in particular curtain-type, rear-ventilated façades, comprising a wall fastening segment, which is designed for mounting the support to a building wall, and a façade fastening segment, which is designed for the mounting of supporting profiled elements and mounting profiled elements.

Supports of this kind are well known from the prior art. For example, EP 0 901 549 B1 thus discloses a wall bracket for façade substructures comprising a fastening leg for mounting the wall bracket on a supporting wall and comprising a supporting leg extending perpendicularly thereto, the supporting leg comprising a leg tab for clamping a supporting profiled element. Wall supports having features of particular curtain-type, rear-ventilated façades, comprising a wall fastening segment, which is designed for mounting the support to a building wall, and a façade fastening segment, which is designed for the mounting of supporting profiled elements and mounting profiled elements are known from EP 2 354 368 A2, DE 10 2009 030 635 A1, DE 30 05 315 A1 and FR 2 924 138 A1.

A drawback of supports of this kind known from the prior art is that said supports are mostly produced as aluminum extruded parts. Aluminum extruded parts of this kind have a high thermal conductivity, meaning that insulation of a building cannot readily be achieved since the aluminum extruded parts act as thermal bridges.

Aluminum extruded parts are also limited in terms of their length and generate high costs during die production.

In addition, supports known from the prior art, for example the wall bracket known from EP 0 901 549 B1, only have one possibility for horizontal or vertical fastening of supporting profiled elements or mounting profiled elements, to which façade elements can be attached in turn.

SUMMARY OF THE INVENTION

The problem addressed by the invention is therefore that of providing a support which makes it possible to fasten supporting profiled elements or mounting profiled elements to a building wall in a simple and secure manner.

This problem is solved by a support characterized in that the façade fastening segment has a first connection segment for the horizontal mounting of supporting profiled elements or mounting profiled elements and a second connection segment for the vertical mounting of supporting profiled elements or mounting profiled elements, which is arranged perpendicularly to the first connection segment. A support of this kind can thus make it possible to mount supporting profiled elements or mounting profiled elements for attaching façade elements both horizontally to the first connection segment and vertically to the second connection segment. Needing to have different supports available in each case for the horizontal and vertical mounting can therefore be avoided.

In this case, it is particularly preferred if the first connection segment is arranged in a plane that is arranged perpendicularly to a plane in which the second connection segment is arranged. The wall fastening segment preferably comprises at least one, preferably two or more mounting holes arranged one above the other, by means of which the wall fastening segment can be fastened, for example screwed, to a building wall.

In a first advantageous development of the support, the first and second connection segments are arranged perpendicularly to a contact surface of the wall fastening segment, which surface is designed for mounting to a building wall. In this case, the contact surface is preferably arranged in a plane that is arranged perpendicularly to the two planes in which the connection segments are each arranged.

Furthermore, according to the invention, the connection segments are arranged on a free end of the support, which end is remote from the wall fastening segment. In this case, it is particularly preferred if the wall fastening segment and the façade fastening segment are integrally interconnected in a support-like manner.

In addition, according to the invention, the connection segments on the free end each have at least one fixed point and one sliding point for mounting supporting profiled elements or mounting profiled elements. In this case, in particular a circular hole can be provided as the fixed point, it being possible for the main load, specifically the weight of the façade arranged on a plurality of supports, to be borne by a fixed point of this kind. In particular, an elongate hole can be provided as the sliding point, it being possible for suction forces and compression forces caused by the wind and acting on a building façade to be diverted by a sliding point of this kind. When providing at least one fixed point and at least one sliding point, it has proven to be particularly advantageous if a plurality of fixed points and sliding points is provided alternately in each case.

In another advantageous development of the support, the support is designed as a bent sheet-metal part. In this case, the sheet metal can be cut by means of a laser or punched in a first step and then, in a second step, a blanked development of the support is folded.

Furthermore, the selection of the sheet metal thickness makes it possible to adapt to loads to be supported, the sheet metal thickness preferably being selected in a range of between 1 and 4 mm. In this case, the sheet metal thickness is preferably selected so as to be adapted to the static requirement in each case. It has further proven particularly advantageous to produce the support preferably from stainless steel, since stainless steel has a lower thermal conductivity than aluminum and thus proves to have a positive impact on thermal decoupling of the façade from a building wall. However, it is also conceivable to produce the support from other materials such as, for example, aluminum or other steel alloys.

Furthermore, it is particularly preferred if the support comprises, in the region of the contact surface of the wall fastening segment, at least one, preferably two claw-like tabs. The tab is advantageously arranged in a plane which is arranged in parallel with the plane of the contact surface. In this case, it is also conceivable for the tab to be arranged in a plane of the contact surface.

In order to thermally decouple the building wall and the façade, it has further proven to be particularly advantageous if a thermal element is provided for thermal insulation against a building wall, which thermal element has a lower heat transfer coefficient than the wall fastening segment and is designed such that it can be clipped onto the contact surface by means of the claw-like tabs. It is particularly preferred if the thermal element is produced from a plastics material, preferably from polyamide.

In another advantageous embodiment of the support, the façade fastening segment comprises a first sheet metal segment that is arranged in the plane of the first contact segment, and a second sheet metal segment that is arranged in the plane of the second contact segment, the first sheet metal segment and the second sheet metal segment being integrally connected. In this case, the first sheet metal segment can thus be arranged perpendicularly to the second sheet metal segment, the sheet metal preferably being bent at an angle of approximately 90°.

Furthermore, it has proven to be particularly advantageous if the second sheet metal segment has a maximum width that is greater than a maximum width of the first sheet metal segment, and if the second sheet metal segment has a minimum width that is greater than a minimum width of the first sheet metal segment. Since the first sheet metal segment is arranged in a plane with the first contact segment, which is provided for mounting horizontally arranged supporting profiled elements or mounting profiled elements, and the second sheet metal segment is arranged in a plane with the second contact segment, which is arranged for mounting vertically arranged supporting profiled elements or mounting profiled elements, a higher moment of resistance against bending can be provided owing to the always greater width of the second sheet metal segment.

Furthermore, in particular when the support is integrally formed, the support can be formed, in the region of the contact surface of the wall fastening segment, as double-layered sheet metal.

In addition, it is particularly advantageous if the wall fastening segment comprises an upper sheet metal segment and a lower sheet metal segment, the upper sheet metal segment forming the contact surface. In this case, it is particularly advantageous if the claw-like tab is arranged in the lower sheet metal segment, i.e. in the sheet metal segment facing away from the building wall when mounted, such that the upper sheet metal segment can be additionally supported by the tab.

In a particularly advantageous embodiment of the support, the first sheet metal segment of the façade fastening segment is integrally connected to the upper sheet metal segment, and the second sheet metal segment of the façade fastening segment is integrally connected to the lower sheet metal segment. In this case, the sheet metal segments are advantageously interconnected at an angle of 90°, for example by bending.

Furthermore, it is particularly preferred if the contact surface has a height that is greater than a maximum width of the contact surface. In this case, the height of the contact surface preferably corresponds to the maximum width of the second sheet metal segment. If the contact surface is greater in height than in width, a high moment of resistance against bending can be achieved in accordance with the design of the sheet metal segments of the façade fastening segment. Using a multi-part, in particular two-part design of the support, a façade cladding that is connected to the two-part support by means of the supporting profiled elements or mounting profiled elements can extend without constraint in a predetermined direction. Visible shifts on the façade surface can thus be prevented.

The support is advantageously integrally formed. In this case, the façade fastening segment and the wall fastening segment are advantageously integrally formed. This is advantageous since an integral support can be produced particularly cost-effectively.

In order to produce a favorable and corrosion-resistant support, it is particularly preferred if the support is made of sheet metal, in particular of stainless steel.

In order to divert bending moments to a building wall, it is furthermore particularly advantageous if the support comprises a tension rod, the tension rod comprising a connection segment that can be connected to the façade fastening segment and a mounting segment remote from the connection segment for mounting to a wall. The tension rod is advantageously designed such that it can be arranged on a building wall centrally above the façade fastening segment, such that bending moments acting on the façade fastening segment can be diverted towards the building wall. In this case, it is particularly preferred if the tension rod comprises an eye-like mounting segment for mounting to a building wall. The provision of a tension rod has proven to be particularly advantageous if only one mounting hole is provided on the wall fastening segment.

The façade fastening segment advantageously comprises a mounting opening for the tension rod. In this case, it is particularly advantageous if the mounting opening is key-hole-like and if the connection segment of the tension rod is arrow-shaped such that it can be secured against being pulled out by rotating it in the mounting opening. The tension rod can thus be fastened to the façade fastening segment simply and without using tools.

Additional details and advantageous developments of the invention can be found in the following description, on the basis of which different embodiments of the invention are described and explained in more detail.

DETAILED DESCRIPTION

Figure 1:
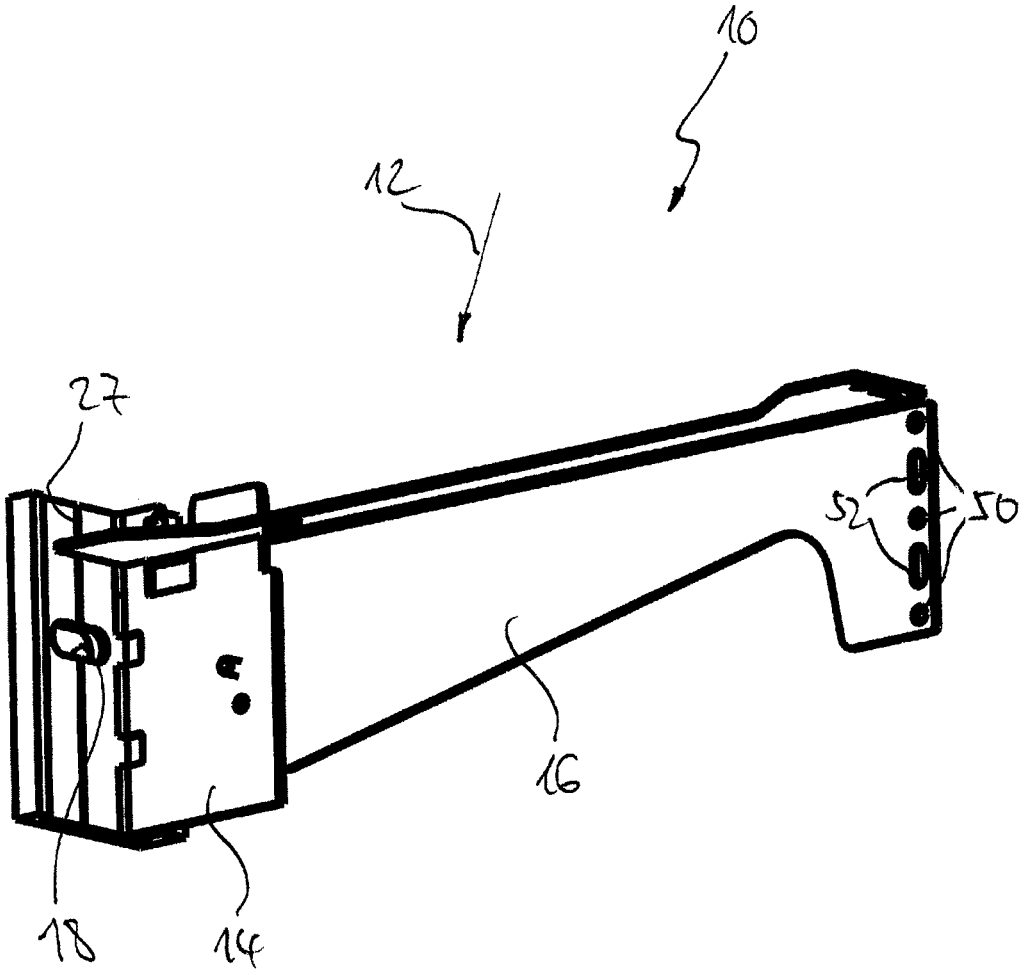
FIG. 1 is an oblique view of a first embodiment of a support according to the invention.

FIGS. 1 to 5 show a first embodiment of a support 10 according to the invention. In this case, the support 10 is shown in FIG. 1 in a first oblique view and in FIG. 2 in a second oblique view, viewed in the direction of the arrow 12 shown in FIG. 1.

Figure 2:
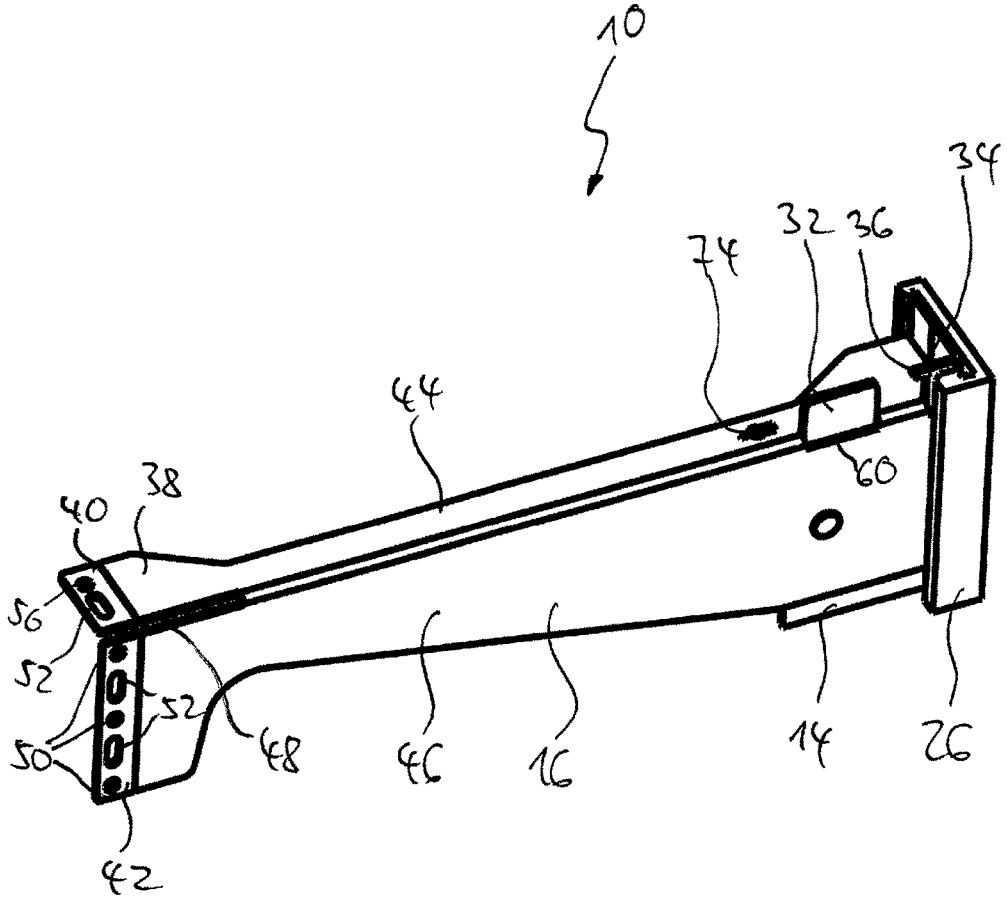
FIG. 2 is another oblique view of the support according to FIG. 2.

As can be seen clearly in FIG. 1 and FIG. 2, the support 10 is formed as a multi-part bent sheet-metal part made of stainless steel. The support 10 comprises a wall fastening segment 14 and a façade fastening segment 16.

Figure 3:
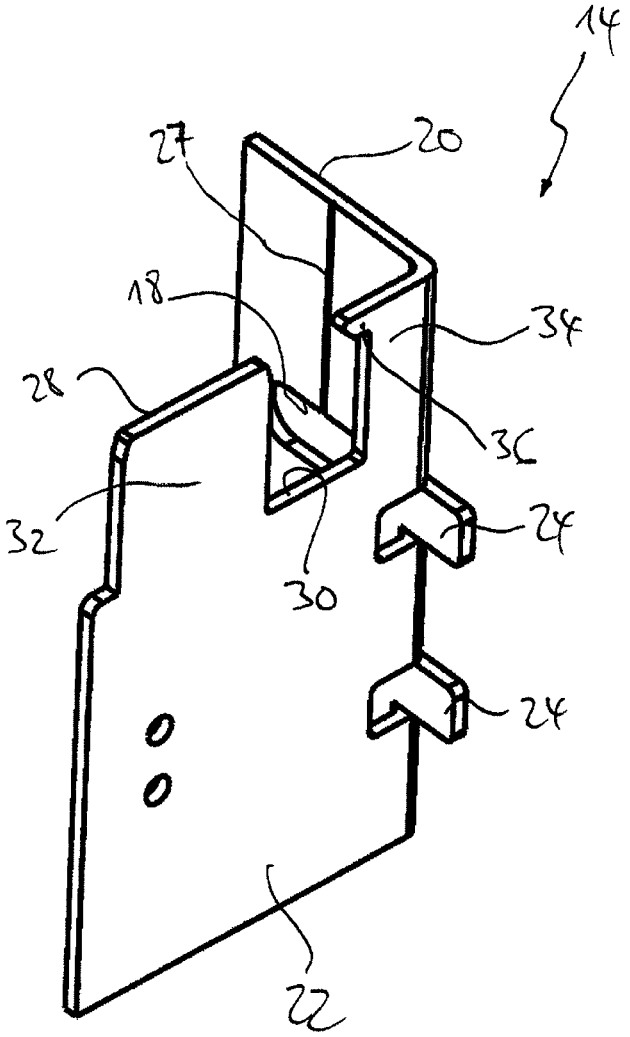
FIG. 3 is an oblique view of a wall fastening segment of the support according to FIGS. 1 and 2.
Figure 4:
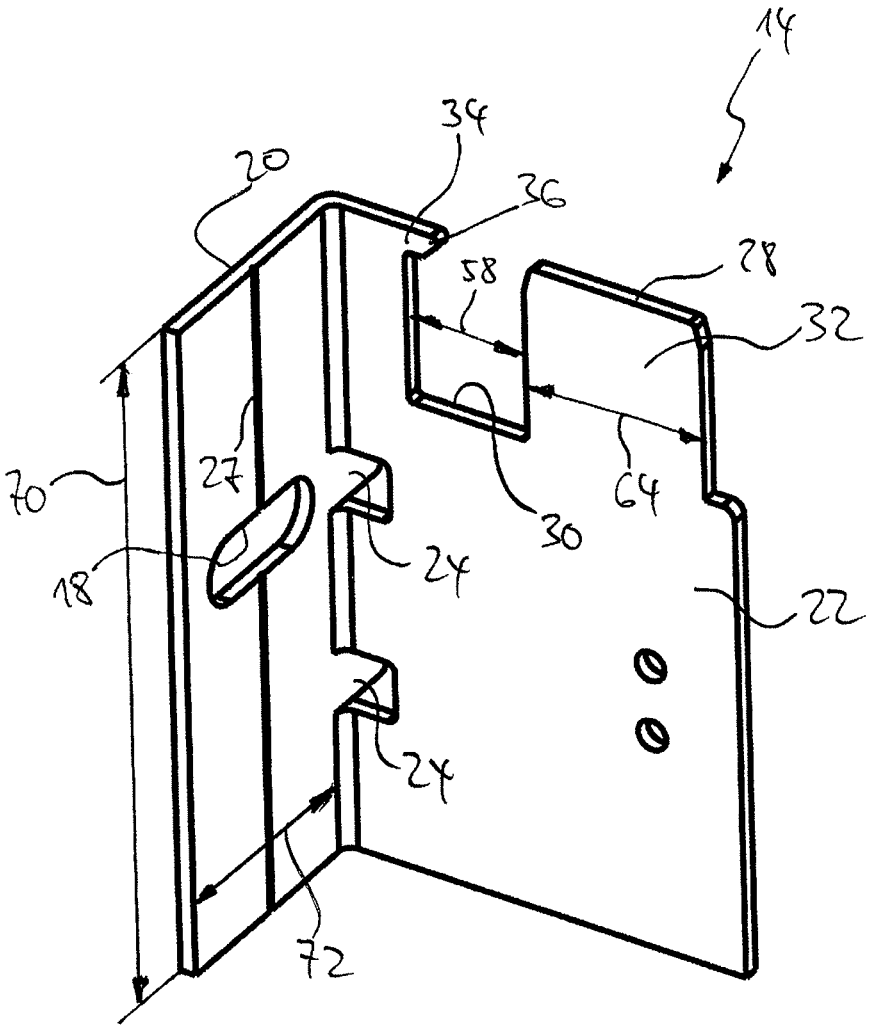
FIG. 4 is another oblique view of the wall fastening segment according to FIG. 3.

The wall fastening segment 14 is designed for mounting the support 10 to a building wall (not shown) by means of the mounting hole 18, and is shown on its own in FIGS. 3 and 4 in two different oblique views. The mounting hole 18 is arranged in a contact surface 20 of the wall fastening segment 14, which is designed for mounting to a building wall.

As can also be seen clearly in FIGS. 3 and 4, the wall fastening segment 14 is formed as a sheet metal angle, a leg 22 being arranged at an angle of approximately 90° to the contact surface 20. The wall fastening segment 14 comprises, in the region of the contact surface, two claw-like tabs 24, which are arranged in a plane with the contact surface 20 and thus widen the contact surface 20. The tabs 24 are furthermore designed to clip a thermal element 26 (shown in FIGS. 1 and 2) made of polyamide or a plastics material having a low heat transfer coefficient onto the tabs 24 or onto the wall fastening segment 14, so that the wall fastening segment 14 can be thermally decoupled from the building wall (not shown). On the side facing away from the contact surface 20, the wall fastening segment 14 comprises a center mark 27 for aligning the support 10 on a wall.

A recess 30 is introduced into the leg 22 on an upper side 28, which recess is designed such that the leg 22 forms two projections 32, 34 on the upper side 28. On the upper side 28, the projection 34 comprises, on its end facing the projection 32, a lug 36 which extends towards the projection 32.

Figure 5:
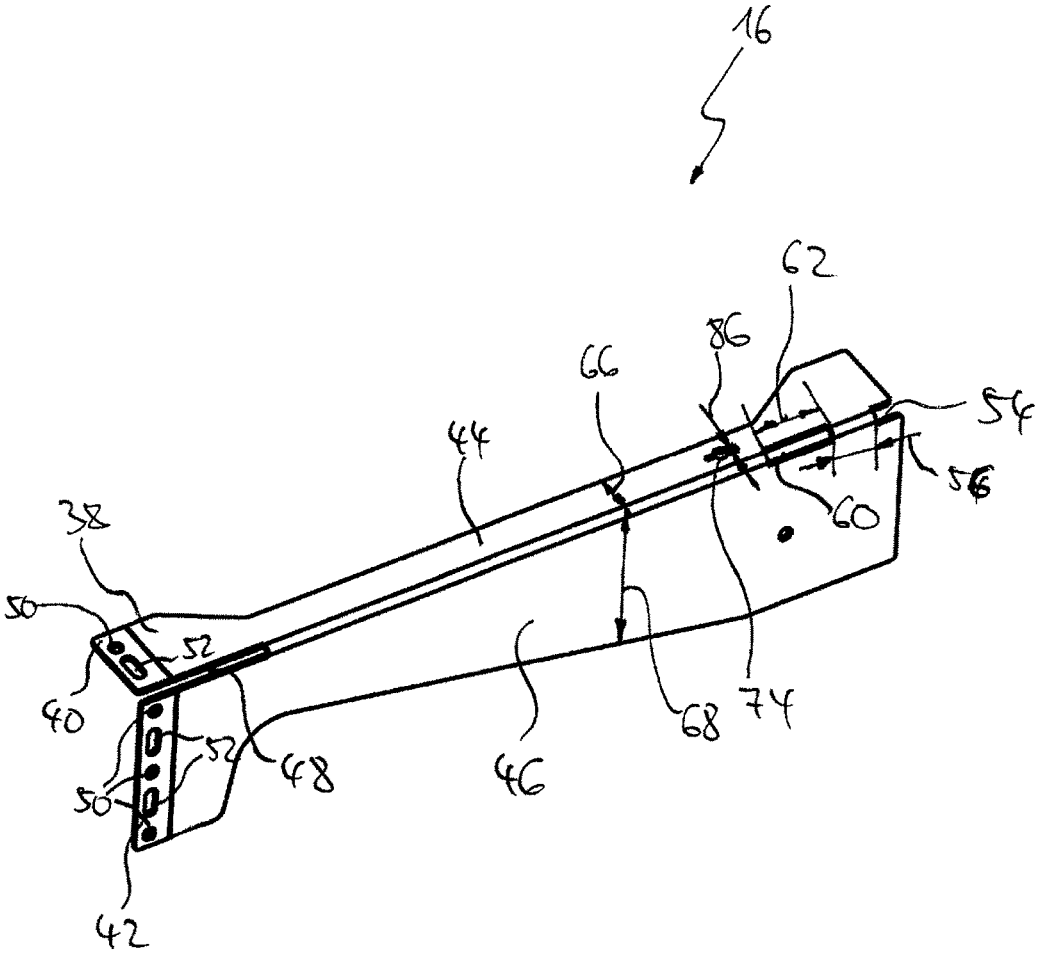
FIG. 5 is an oblique view of a façade fastening segment of the support according to FIGS. 1 and 2.

The façade fastening segment 16 is shown on its own in FIG. 5. The free end 38 of the façade fastening segment 16 comprises a first connection segment 40 for the horizontal mounting of supporting profiled elements or mounting profiled elements (not shown) and a second connection segment 42 for the vertical mounting of supporting profiled elements or mounting profiled elements, the second connection segment 42 being arranged perpendicularly to the first connection segment 40.

The façade fastening segment 16 further comprises a first sheet metal segment 44 that is arranged in a plane of the first contact segment 40, and a second sheet metal segment 46 that is arranged in a plane of the second contact segment 42, the first sheet metal segment 44 and the second sheet metal segment 46 being integrally interconnected. The first sheet metal segment 44 and the second sheet metal segment 46 are arranged relative to one another at an angle of 90° by bending.

In the region of the free end 38, a slot 48 that is open towards the free end 38 is provided between the first sheet metal segment 44 and the second sheet metal segment 46, which slot is provided for feeding through segments of a particular supporting profiled element or mounting profiled element when mounting supporting profiled elements or mounting profiled elements on the connection segments 40, 42. The connection segments 40, 42 each further comprise at least one fixed point 50 formed as a circular hole and at least one sliding point 52 formed as an elongate hole.

By means of a fixed point 50 of this kind, the main load, specifically the weight of the façade arranged on a plurality of supports 10, can be borne, it being possible for suction forces and compression forces caused by the wind and acting on a building façade to be diverted by a sliding point 52 of this kind.

On the side remote from the free end 38, the façade fastening segment 16 also comprises an open slot 54 between the first sheet metal segment 44 and the second sheet metal segment 46. At a spacing 56 from the slot 54 which is slightly smaller than a width 58 of the recess 30 of the wall fastening segment 14, an additional slot 60 is arranged between the first sheet metal segment 44 and the second sheet metal segment 46.

The slot 60 has a length 62 which is selected so as to be slightly greater than a width 64 of the projection 32 of the wall fastening segment 14, meaning that the façade fastening segment 16, as shown in FIGS. 1 and 2, can be connected to the wall fastening segment 14, the projection 32 being introduced into the slot 60 and the lug 36 preventing the façade fastening segment 16 from sliding out.

In order to provide a moment of resistance against bending that is as high as possible, the first sheet metal segment 44 has a width 66, the second sheet metal segment 46 having a width 68. The width 68 and the width 66 are each selected such that the maximum width 68 along the longitudinal extension of the façade fastening segment 16 is always greater than the relevant maximum width 66 and such that the minimum width 68 along the longitudinal extension of the façade fastening segment 16 is likewise always greater than the relevant minimum width 66.

Likewise for providing a moment of resistance against bending that is as high as possible, the contact surface 20 has a height 70, which is greater than a maximum width 72 of the contact surface 20. This can be seen clearly in FIG. 4.

Figure 10:
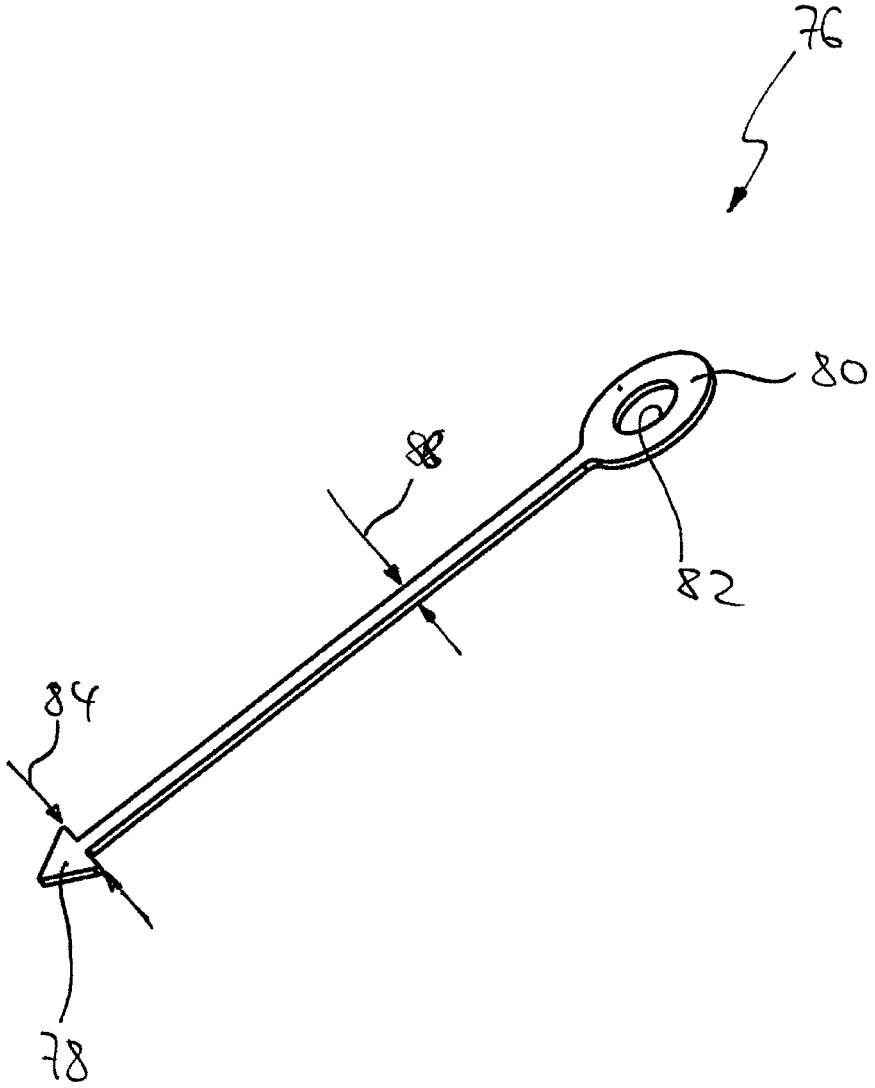
FIG. 10 is an oblique view of a tension rod for a support according to the invention.

In the event that the wall fastening segment 14, as in FIGS. 1 to 4, only comprises one mounting hole 18, the façade fastening segment 16 comprises, on the sheet metal segment 44, a keyhole-like mounting opening 74 for a tension rod 76 (shown in FIG. 10).

The tension rod 76 comprises a connection segment 78 that can be connected to the façade fastening segment 16 and a mounting segment 80 remote from the connection segment 78 for mounting to a building wall. In this case, the tension rod 76 is designed such that it can be arranged on a building wall centrally above the façade fastening segment 16, such that bending moments acting on the façade fastening segment 16 can be diverted towards the building wall.

In this case, it is particularly preferred if the tension rod 76 comprises an eye-like mounting segment 80 having a hole 82 for mounting to a building wall. The connection segment 78 of the tension rod 76 is arrow-shaped such that it can be secured against being pulled out by rotating it in the mounting opening 80. For this purpose, the connection segment of the tension rod has a width 84 that is greater than a width 86 of the mounting opening 74 in the façade fastening segment 16. Furthermore, the tension rod 76 has, at its narrowest point, a width 88 that is slightly smaller than the width 86 of the façade fastening segment 16. The tension rod 76 can thus be fastened to the façade fastening segment 16 simply and without using tools.

In order to fasten the support 10, a screw connection is first produced by means of the mounting hole 18, the tension rod 76 arranged in the mounting opening 74 then being screwed to a wall above the screw connection of the mounting hole 18.

Figure 6:
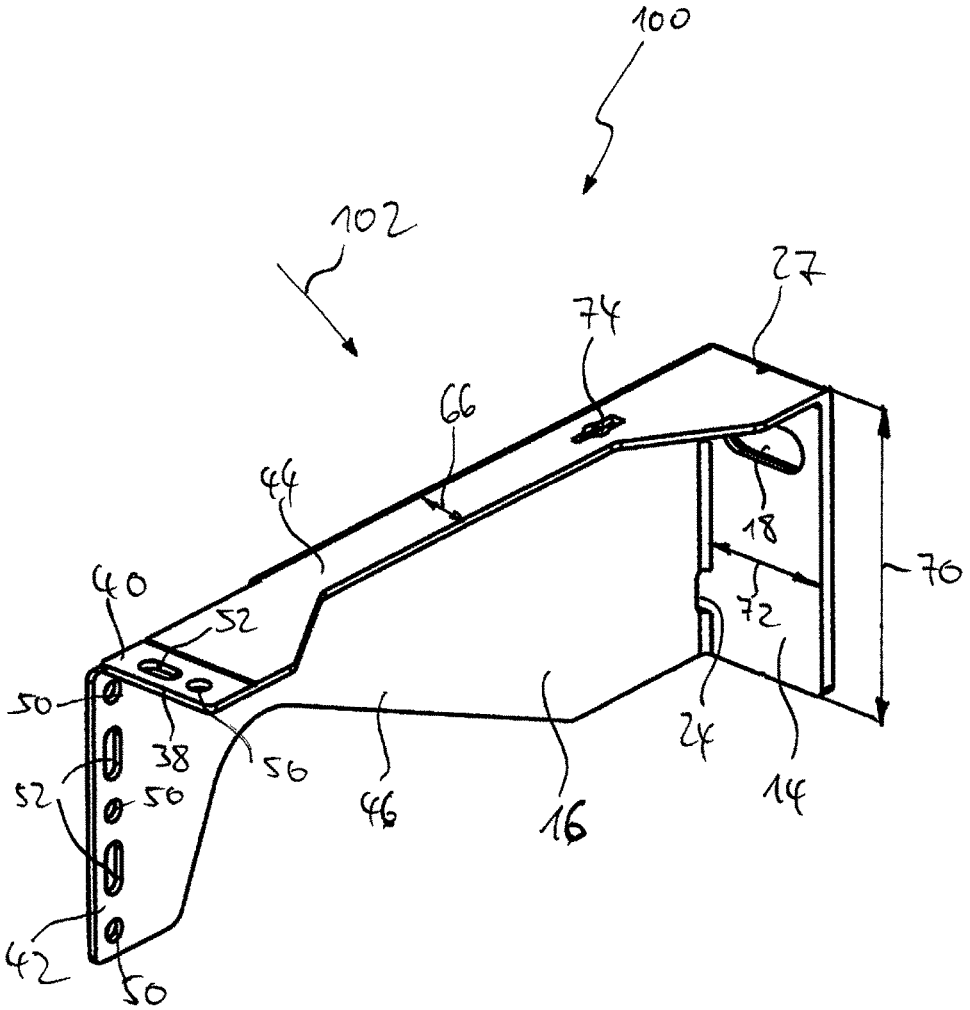
FIG. 6 is another oblique view of the façade fastening segment according to FIG. 5.

FIGS. 6 to 9 show a second embodiment of a support 100 according to the invention. Elements corresponding to the support 10 according to FIGS. 1 to 5 are denoted by corresponding reference signs. In this case, the support 100 is shown in FIG. 6 in a first oblique view and in FIG. 7 in a second oblique view when viewed in the direction of the arrow 102 shown in FIG. 6.

Figure 7:
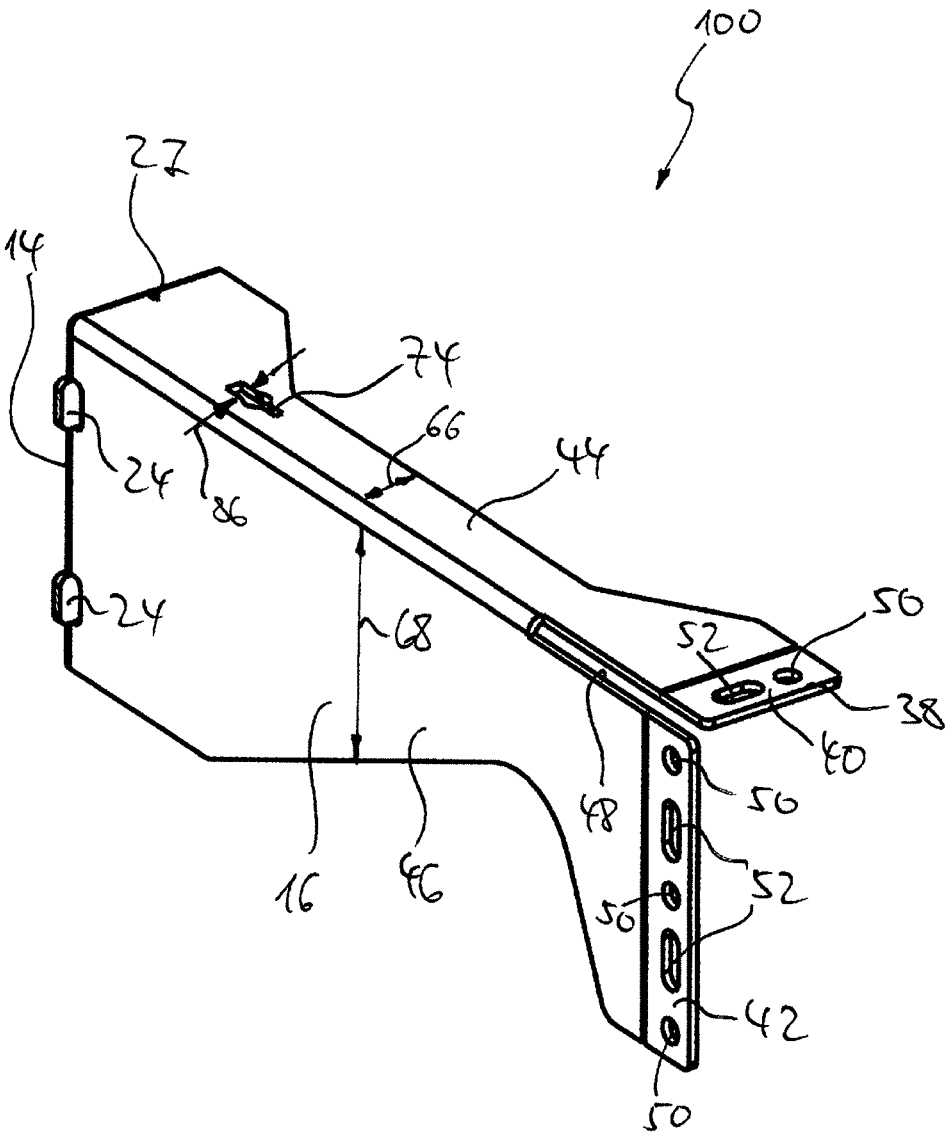
FIG. 7 is an oblique view of a second embodiment of a support according to the invention.

As can be seen clearly in FIG. 6 and FIG. 7, the support 100 is formed as an integral bent sheet-metal part made of stainless steel. This is advantageous in comparison with the support 10 according to FIGS. 1 to 5 since it is less expensive to produce.

The support 100 also comprises a wall fastening segment 14 and a façade fastening segment 16, the wall fastening segment 14 and the façade fastening segment 16 being integral.

Figure 8:
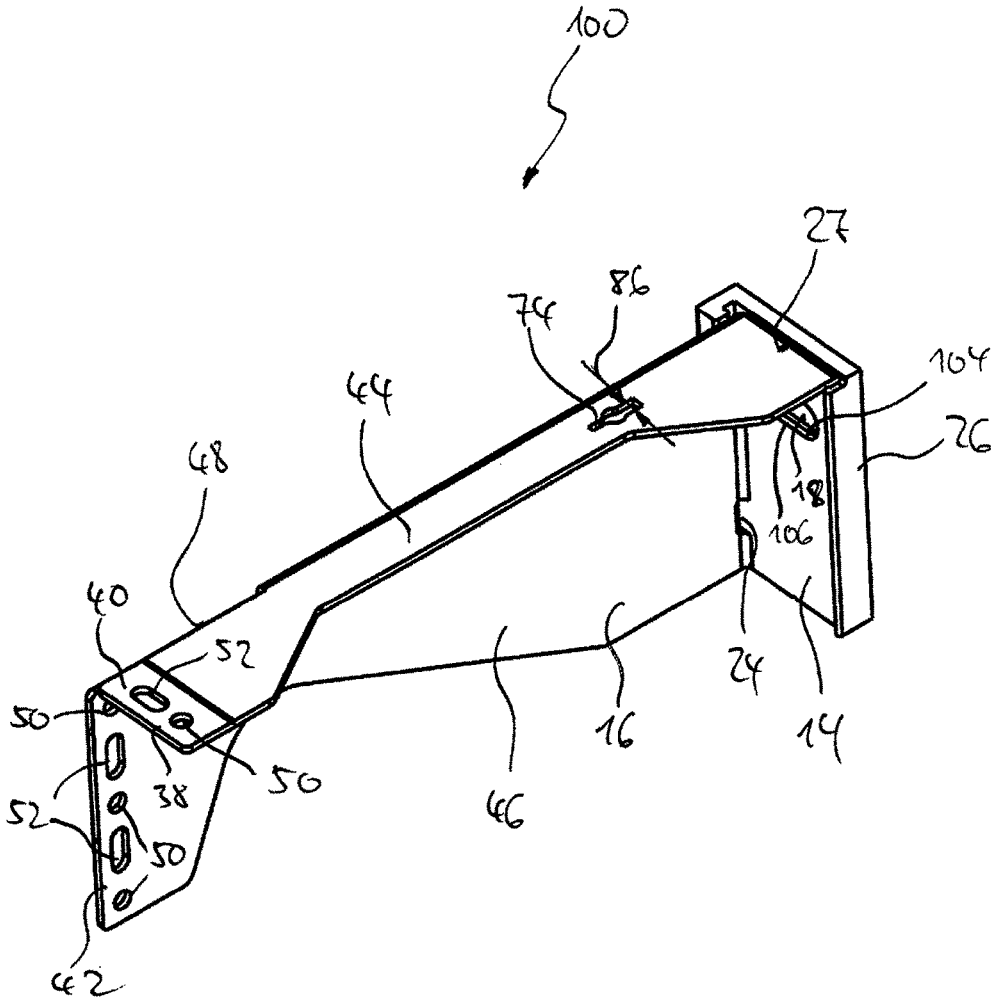
FIG. 8 is another oblique view of the support according to FIG. 7 with a thermal element arranged thereon.
Figure 9:
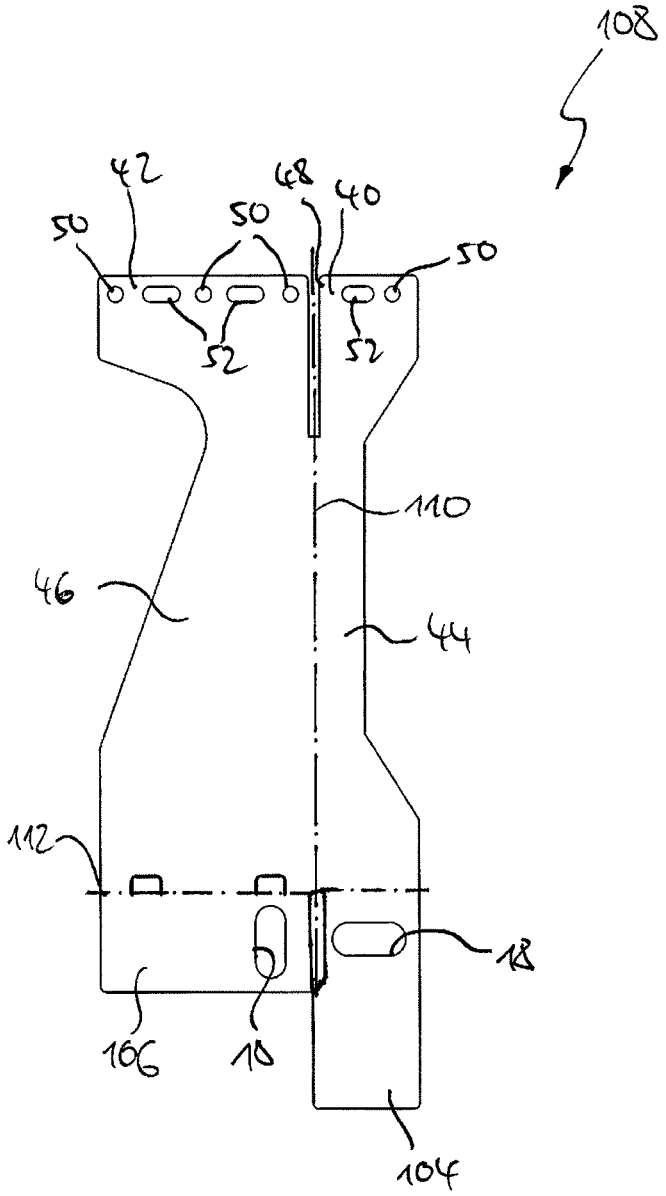
FIG. 9 shows a development of the support according to FIGS. 7 and 8.

In this case, the support 100 is formed, in the region of the contact surface 20, as double-layered sheet metal, the wall fastening segment 14 comprising an upper sheet metal segment 104 and a lower sheet metal segment 106, which can be seen clearly in FIG. 8. In this case, the upper sheet metal segment 104 forms the contact surface 20.

Owing to the integral design, the first sheet metal segment 44 of the façade fastening segment 16 is integrally connected to the upper sheet metal segment 104, the second sheet metal segment 46 being integrally connected to the lower sheet metal segment 106. This can also be seen clearly in FIG. 9, which shows a development 108 of the support 100 according to FIGS. 7 and 8.

The development 108 is produced by laser cutting from sheet metal, all slots, recesses and fastening points having already been introduced into the sheet metal by laser cutting.

The first sheet metal segment 44 is first bent relative to the second sheet metal segment 64 about a bend line 110 until the sheet metal segments 44, 46 are arranged at an angle of approximately 90° relative to one another.

In a second step, the lower sheet metal segment 106 is bent about a bend line 112 until the lower sheet metal segment 106 is arranged at an angle of approximately 90° to the second sheet metal segment 46.

Finally, in a third step, the upper sheet metal segment 104 is bent about a bend line 114 until the upper sheet metal segment 104 is arranged at an angle of approximately 90° to the first sheet metal segment 44 and lies over the lower sheet metal segment 106 such that the mounting holes 18 overlap.

The support 100 according to FIGS. 5 to 9 is mounted in a similar manner to the support 10 according to FIGS. 1 to 5.

What is claimed is:

1. Support for fastening façade elements of a rear-ventilated facade comprising a wall fastening segment configured for mounting the support to a building wall, and a façade fastening segment configured for mounting supporting profiled elements and mounting profiled elements, characterized in that the façade fastening segment has a first connection segment configured for horizontal mounting of the supporting profiled elements or the mounting profiled elements and a second connection segment configured for vertical mounting of the supporting profiled elements or the mounting profiled elements, which is arranged perpendicularly to the first connection segment, wherein the connection segments are each arranged on a free end of the support remote from the wall fastening segment and wherein the connection segments on the free end each comprise at least one fixed point and one sliding point configured for mounting the supporting profiled elements or the mounting profiled elements, and wherein the support is composed of a bent sheet-metal.

2. Support according to claim 1, characterized in that the support is integrally formed.

3. Support according to claim 1, characterized in that the bent sheet-metal of the support is stainless steel.

4. Support according to claim 1, characterized in that the support comprises a tension rod, the tension rod comprising a third connection segment that is configured to be connected to the façade fastening segment and a mounting segment remote from the third connection segment for mounting to the wall.

5. Support according to claim 4, characterized in that the façade fastening segment comprises a mounting opening for the tension rod.

6. Support according to claim 1, characterized in that the façade fastening segment comprises a first sheet metal segment that is arranged in a plane of the first contact segment, and a second sheet metal segment that is arranged in a plane of the second contact segment, the first sheet metal segment and the second sheet metal segment being integrally connected.

7. Support according to claim 6, characterized in that the second sheet metal segment has a maximum width that is greater than a maximum width of the first sheet metal segment, and in that the second sheet metal segment has a minimum width that is greater than a minimum width of the first sheet metal segment.

8. Support according to claim 6, characterized in that the first sheet metal segment of the façade fastening segment is integrally connected to the upper sheet metal segment, and in that the second sheet metal segment of the façade fastening segment is integrally connected to the lower sheet metal segment.

9. Support according to claim 1, characterized in that the first and second connection segments are arranged perpendicularly to a contact surface of the wall fastening segment, which surface is designed for mounting to the building wall.

10. Support according to claim 9, characterized in that the wall fastening segment comprises an upper sheet metal segment and a lower sheet metal segment, the upper sheet metal segment forming the contact surface.

11. Support according to claim 9, characterized in that the contact surface has a height that is greater than a maximum width of the contact surface.

12. Support according to claim 9, characterized in that the support comprises, in a region of the contact surface of the wall fastening segment, at least one tab.

13. Support according to claim 12, characterized in that a thermal element is provided for thermal insulation against the building wall, which thermal element has a lower heat transfer coefficient than the wall fastening segment and is designed such that the thermal element is configured to be clipped onto the contact surface by means of the tab.

14. Support according to claim 12, characterized in that the support is formed, in the region of the contact surface of the wall fastening segment, as double-layered sheet metal.

* * * * *